US010049562B2

(12) United States Patent
Volam et al.

(10) Patent No.: US 10,049,562 B2
(45) Date of Patent: Aug. 14, 2018

(54) SENSOR COMMUNICATION TESTING

(71) Applicant: Honeywell International Inc., Morris Plains, NJ (US)

(72) Inventors: Praveen Kumar Volam, Mahabubabad (IN); Prabhu Palanisamy, Bangalore (IN); Madhu T. Chandrashekar, Bangalore (IN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/333,913

(22) Filed: Oct. 25, 2016

(65) Prior Publication Data

US 2018/0114431 A1 Apr. 26, 2018

(51) Int. Cl.
*G08B 29/14* (2006.01)
*G08B 25/10* (2006.01)

(52) U.S. Cl.
CPC ..... *G08B 29/145* (2013.01); *G08B 25/10* (2013.01)

(58) Field of Classification Search
CPC ..... G08B 29/145; G08B 25/10
See application file for complete search history.

(56) References Cited

U.S. PATENT DOCUMENTS 7,808,397 B2 * 10/2010 Arita ..... G08B 25/10 340/539.1
8,638,210 B2 * 1/2014 Simon ..... G08B 29/16 340/506
9,094,056 B2 * 7/2015 Ouyang ..... H04B 5/0043
9,369,633 B2 7/2016 Sannala
9,425,979 B2 8/2016 Cregg
2004/0217857 A1 11/2004 Lennartz et al.
2005/0192710 A1 * 9/2005 Thornton ..... A01G 25/16 700/284
2007/0171051 A1 * 7/2007 Kashiwagi ..... G08B 25/10 340/539.22
2007/0241879 A1 10/2007 Jobe et al.
2008/0084291 A1 4/2008 Campion et al.
2014/0194069 A1 * 7/2014 Liu ..... H04W 24/00 455/67.14
2015/0077248 A1 * 3/2015 Eck ..... G08B 17/10 340/539.26
2015/0120000 A1 4/2015 Coffey et al.
2015/0287152 A1 10/2015 Oakes
2015/0348399 A1 12/2015 Cree

OTHER PUBLICATIONS

Extended Search and Opinion from related European Patent Application No. 17197964, dated Apr. 9, 2018, 12 pages.

* cited by examiner

*Primary Examiner* — Mohamed Barakat
(74) *Attorney, Agent, or Firm* — Brooks, Cameron & Huebsch, PLLC

(57) ABSTRACT

Sensor communication testing is described herein. For example, one or more embodiments include a sensor comprising a wireless transmitter configured to generate a radio-frequency (RF) signal, an RF attenuator configured to direct the RF signal in a pre-determined direction, and a controller configured to receive a self-test command to execute a communication test, send a communication test signal to a sensor panel in response to the self-test command, and receive a communication test response signal from the sensor panel in response to the communication test signal, where the communication test response signal indicates whether the sensor has passed or failed the communication test.

20 Claims, 3 Drawing Sheets

SENSOR COMMUNICATION TESTING

TECHNICAL FIELD

The present disclosure relates to sensor communication testing.

BACKGROUND

Sensors may be periodically tested to determine whether they are in working order. Testing sensors can include testing sensing capabilities, as well as testing communication capabilities. For example, testing sensor communication capability may include causing a sensor to send and receive communication from a central monitoring location.

Sensors may need to be periodically tested by law. For example, building codes and/or regulations can call for periodic testing of various types of sensors, such as smoke and/or fire sensors. Testing such sensors may include causing a sensor to send a signal to the central monitoring location, and receive a signal from the central monitoring location to ensure the sensor can effectively communicate an alarm event, such as to the central monitoring location.

DETAILED DESCRIPTION

Figure 1:
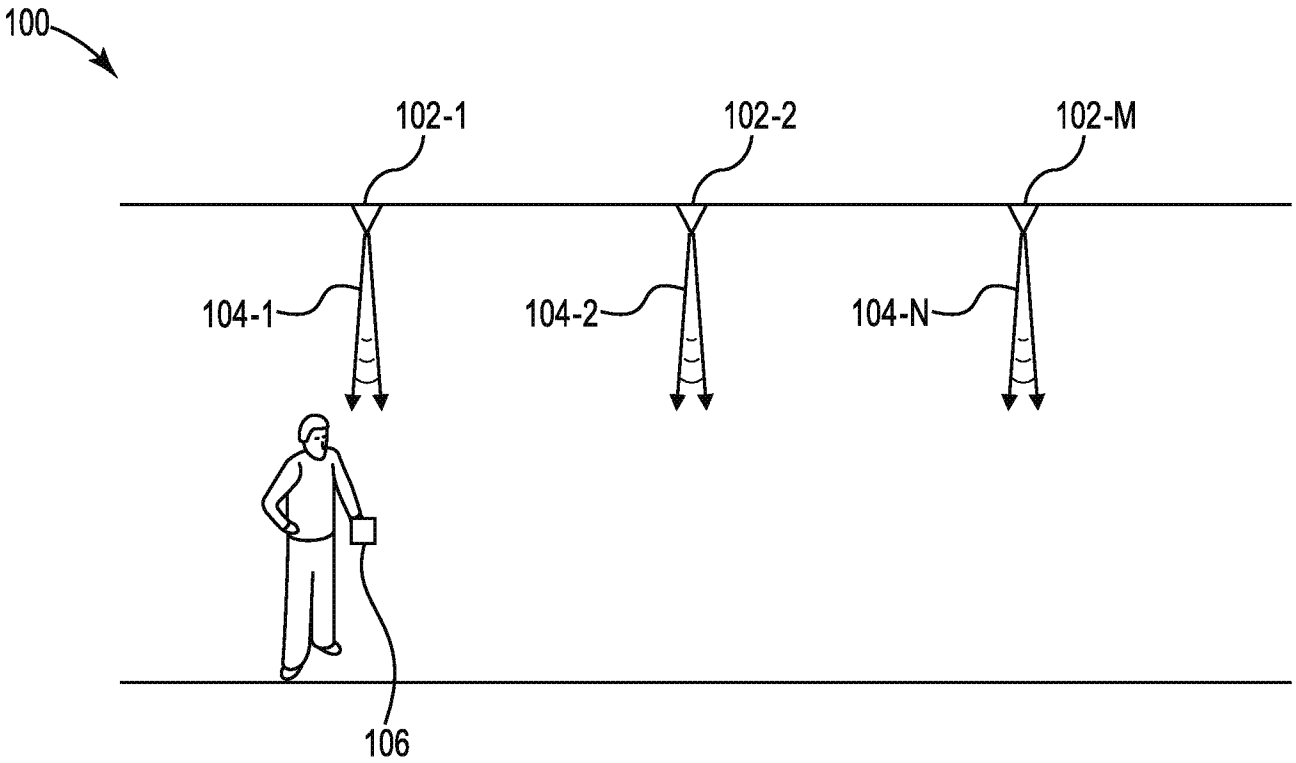
FIG. 1 is an example of a system for sensor communication testing, in accordance with one or more embodiments of the present disclosure.

Sensor communication testing is described herein. For example, one or more embodiments include a sensor comprising a wireless transmitter configured to generate a radio-frequency (RF) signal, an RF attenuator configured to direct the RF signal in a pre-determined direction, and a controller configured to receive a self-test command to execute a communication test, send a communication test signal to a sensor panel in response to the self-test command, and receive a communication test response signal from the sensor panel in response to the communication test signal, where the communication test response signal indicates whether the sensor has passed or failed the communication test.

Previous sensor communication testing methods include a first user, such as a maintenance worker or building technician, causing an alarm event at a sensor, and a second user to verify, at the central monitoring location, whether the sensor is effectively communicating the alarm event to the central monitoring station. This method may include the first user having to use a ladder to access sensors to cause alarm events, since many sensors are located near or in ceiling areas. The second user, who is in communication with the first user, can verify sensor communication with the central monitoring location and log each successful or failed sensor test. Further, many buildings can have a large number of sensors, and testing each sensor can take a significant amount of time, which may result in high testing costs.

Sensor communication testing, in accordance with the present disclosure, may utilize a mobile device to cause a sensor to communicate with a central monitoring location. As a result, a single user can perform sensor communication testing, allowing for faster and cheaper testing of sensors.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of sensors" can refer to one or more sensors. Additionally, the designators "M" and "N", as used herein, particularly with respect to reference numerals in the drawings, indicate that a number of the particular feature so designated can be included with a number of embodiments of the present disclosure.

FIG. 1 is an example of a system 100 for sensor communication testing, in accordance with one or more embodiments of the present disclosure. As shown in FIG. 1, the system 100 can include a sensor 102-1, 102-2, 102-M, a directed radio-frequency (RF) signal 104-1, 104-2, 104-N, and a mobile device 106.

Sensor 102-1, 102-2, 102-M can be a building sensor. Sensor 102-1, 102-2, 102-M can include a wireless transmitter to generate an RF signal, and an RF attenuator to direct the RF signal in a pre-determined direction. As used herein, an RF signal refers to an electromagnetic wave with a specified frequency. As used herein, a wireless transmitter refers to a device that generates RF signals.

Sensor 102-1, 102-2, 102-M can be a heating, ventilation, and air-conditioning (HVAC) sensor. For example, sensor 102-1, 102-2, 102-M may be a carbon-dioxide ($CO_2$) sensor (e.g., to detect levels of $CO_2$), a current sensor (e.g., to monitor electrical current of HVAC equipment), a humidity sensor (e.g., to monitor humidity and/or relative humidity), an occupancy sensor (e.g., to monitor space occupancy, such as for HVAC applications), a pressure sensor (e.g., to measure pressure), and/or a temperature sensor (e.g., to measure temperature), although embodiments of the present disclosure are not limited to the listed HVAC sensors.

Sensor 102-1, 102-2, 102-M can be a lighting sensor. For example, sensor 102-1, 102-2, 102-M may be an occupancy sensor such as an ultrasonic, passive infrared, or a combination ultrasonic and passive infrared occupancy sensor (e.g., to monitor space occupancy for lighting applications) and/or a photo sensor (e.g., to monitor an amount of daylight in a space), although embodiments of the present disclosure are not limited to the listed lighting sensors.

Sensor 102-1, 102-2, 102-M can be a smoke and/or fire sensor. For example, sensor 102-1, 102-2, 102-M may be a smoke sensor, such as a photoelectric and/or ionization smoke detector (e.g., to detect smoke) and/or a fire sensor, such as a UV, near IR array, IR, infrared thermal camera, UV/IR, and/or dual IR/IR fire detector (e.g., to detect a fire), although embodiments of the present disclosure are not limited to the listed smoke and/or fire sensors.

The wireless transmitter can be a Bluetooth/Bluetooth low energy (BLE) transmitter. As used herein, a BLE transmitter refers to a BLE wireless transmitter that can generate RF signals. For example, sensor 102-1, 102-2, 102-M can include a BLE transmitter to generate a directed RF signal 104-1, 104-2, 104-N.

The wireless transmitter can be a sub-gigahertz transmitter. As used herein, a sub-gigahertz transmitter refers to a wireless transmitter that can generate RF signals in a frequency band of less than 1 gigahertz (GHz). For example, sensor 102-1, 102-2, 102-M can include a sub-gigahertz transmitter to generate a directed RF signal 104-1, 104-2, 104-N.

The wireless transmitter can be a Wi-Fi transmitter. As used herein, a Wi-Fi transmitter refers to a wireless transmitter that can generate RF signals in a 2.4 GHz ultra-high frequency band and/or a 5 GHz super-high frequency industrial, scientific and medical (ISM) band. For example, sensor 102-1, 102-2, 102-M can include a Wi-Fi transmitter to generate a directed RF signal 104-1, 104-2, 104-N.

The wireless transmitter can be a Light Fidelity (Li-Fi) transmitter. As used herein, a Li-Fi transmitter refers to a wireless transmitter using light communication operating in ultra-violet (UV) visible light, infrared, and/or near UV spectra. For example, sensor 102-1, 102-2, 102-M can include a Li-Fi transmitter to generate a directed RF signal 104-1, 104-2, 104-N.

Figure 3:
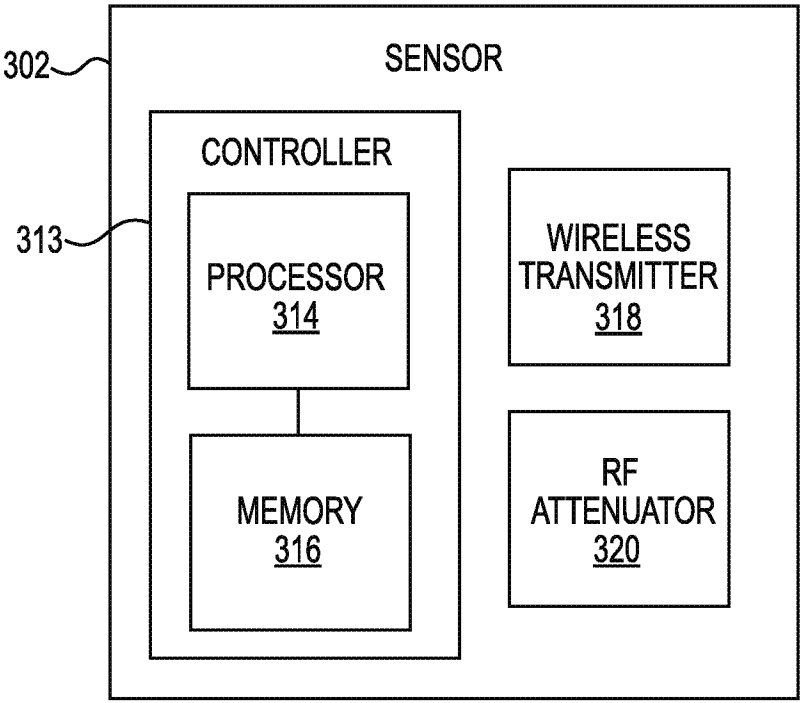
FIG. 3 is a schematic block diagram of a sensor for sensor communication testing, in accordance with one or more embodiments of the present disclosure.

Sensor 102-1, 102-2, 102-M can include an RF attenuator, as will be further described with respect to FIG. 3. The RF attenuator can direct the RF signal 104-1, 104-2, 104-N in a pre-determined direction. For example, as shown in FIG. 1, the RF attenuator can direct the RF signal 104-1, 104-2, 104-N of sensor 102-1, 102-2, 102-M in a substantially downwards direction, as sensor 102-1, 102-2, 102-M are located in a higher location relative to mobile device 106.

Although the directed RF signal 104-1, 104-2, 104-N is shown in FIG. 1 and described as being directed in a substantially downwards direction, embodiments of the present disclosure are not so limited. For example, the directed RF signal 104-1, 104-2, 104-N may be directed at any angle between 0° and 180° relative to the placement of the sensor. That is, as shown in FIG. 1, the RF signal is shown as being directed at a 90° angle; however, the RF signal may be directed at an angle less than 90° or more than 90° relative to the placement of the sensor.

In some embodiments, a sensor may be located on a wall. For instance, the directed RF signal of the wall sensor may be directed away from the sensor at a 90° angle relative to the wall; however, the RF signal may be directed at an angle less than 90° (e.g., towards the floor) or more than 90° (e.g., towards the ceiling) relative to the placement of the sensor.

As shown in FIG. 1, the system 100 can include a mobile device 106. Mobile device 106 can send a self-test command to a sensor 102-1, 102-2, 102-M in response to mobile device 106 being in proximity with the directed RF signal 104-1, 104-2, 104-N. As used herein, a self-test command refers to an instruction sent to the sensor 102-1, 102-2, 102-M to cause the sensor 102-1, 102-2, 102-M to execute a communication test. A communication test can include the sensor 102-1, 102-2, 102-M sending a signal to a central monitoring location, and receiving a signal from the central monitoring location, as will be further described with respect to FIG. 2.

As used herein, a mobile device can include devices that are (or can be) carried and/or worn by a user. For example, a mobile device can be a phone (e.g., a smart phone), a tablet, a personal digital assistant (PDA), smart glasses, and/or a wrist-worn device (e.g., a smart watch), among other types of mobile devices.

Mobile device 106 can send the self-test command to a controller of sensor 102-1, 102-2, 102-M when mobile device 106 is in proximity with the directed RF signal 104-1, 104-2, 104-N of sensor 102-1, 102-2, 102-M, respectively. As used herein, a mobile device being in proximity with a directed RF signal refers to the mobile device being within a proximate and/or a threshold distance to the directed RF signal such that the mobile device can communicate with the sensor. For example, as shown in FIG. 1, mobile device 106 is shown as being within proximity of directed RF signal 104-1 of sensor 102-1, but would not be within proximity of directed RF signals 104-2, 104-N. In this example, mobile device 106 can send, to sensor 102-1, a self-test command to sensor 102-1. A controller of sensor 102-1 can receive the self-test command in response to mobile device 106 being in proximity with the directed RF signal 104-1, and cause sensor 102-1 to execute a communication test, as will be further described herein.

In some embodiments, sensors may be located in or around ceiling areas. A proximate distance to a sensor located in or around a ceiling area may be one or two meters, although embodiments of the present disclosure are not limited to a one or two meter proximate distance. For instance, the proximate distance may be less than one meter or more than one meter.

In some embodiments, a user using mobile device 106 may be able to select which sensor to cause to execute a communication test. For instance, in an example where mobile device 106 is in proximity with more than one sensor, a user may select, via a graphical user interface of mobile device 106, which sensor to cause to execute a communication test.

The graphical user interface can display control and/or monitoring information related to the number of sensors 102-1, 102-2, 102-M. In some embodiments, the user interface can be a graphical user interface (GUI) that can provide and/or receive information to and/or from a user. The display can be, for instance, a touch-screen (e.g., the GUI can include touch-screen capabilities). The graphical user interface can be a mobile device screen, such as a screen of mobile device 106.

In response to receiving the self-test command from mobile device 106, the sensor 102-1, 102-2, 102-M can send a communication test signal to a sensor panel. As used herein, a sensor panel refers to a central monitoring location for sensors located in a building. For example, the sensor 102-1, 102-2, 102-M can send a communication test signal to the sensor panel to test communication between the sensor 102-1, 102-2, 102-M and the sensor panel. A signal may be correspondingly sent from the sensor panel to the sensor 102-1, 102-2, 102-M, as will be further described in connection with FIG. 2.

Mobile device 106 can receive a pass notification in response to the sensor 102-1, 102-2, 102-M passing the communication test. For example, mobile device 106 may receive a notification from a management server connected to the sensor panel if the sensor 102-1, 102-2, 102-M passes the communication test. For instance, mobile device 106 may send a self-test command to sensor 102-1 causing sensor 102-1 to send a communication test signal to the sensor panel. Mobile device 106 can receive a notification indicating that sensor 102-1 has passed the communication test, which can be displayed on the graphical user interface of mobile device 106. The pass notification can be received from a management server connected to the sensor panel, as will be further described in connection with FIG. 2.

Mobile device 106 can receive a fail notification in response to the sensor 102-1, 102-2, 102-M failing the communication test. For example, mobile device 106 may receive a notification from a management server connected to the sensor panel if the sensor 102-1, 102-2, 102-M fails the communication test. For instance, mobile device 106 may send a self-test command to sensor 102-1 causing sensor 102-1 to send a communication test signal to the sensor panel. Mobile device 106 can receive a notification indicating that sensor 102-1 has failed the communication test, which can be displayed on the graphical user interface of mobile device 106. The fail notification can be received from a management server connected to the sensor panel, as will be further described in connection with FIG. 2.

Sensor communication testing can allow for a single user to perform communication testing on a large number of sensors in a short amount of time. By utilizing a mobile device, a user no longer needs to carry a ladder to access sensors which may be otherwise difficult to access. Sensor communication testing can allow for faster sensor communication testing, resulting in lower testing costs.

Figure 2:
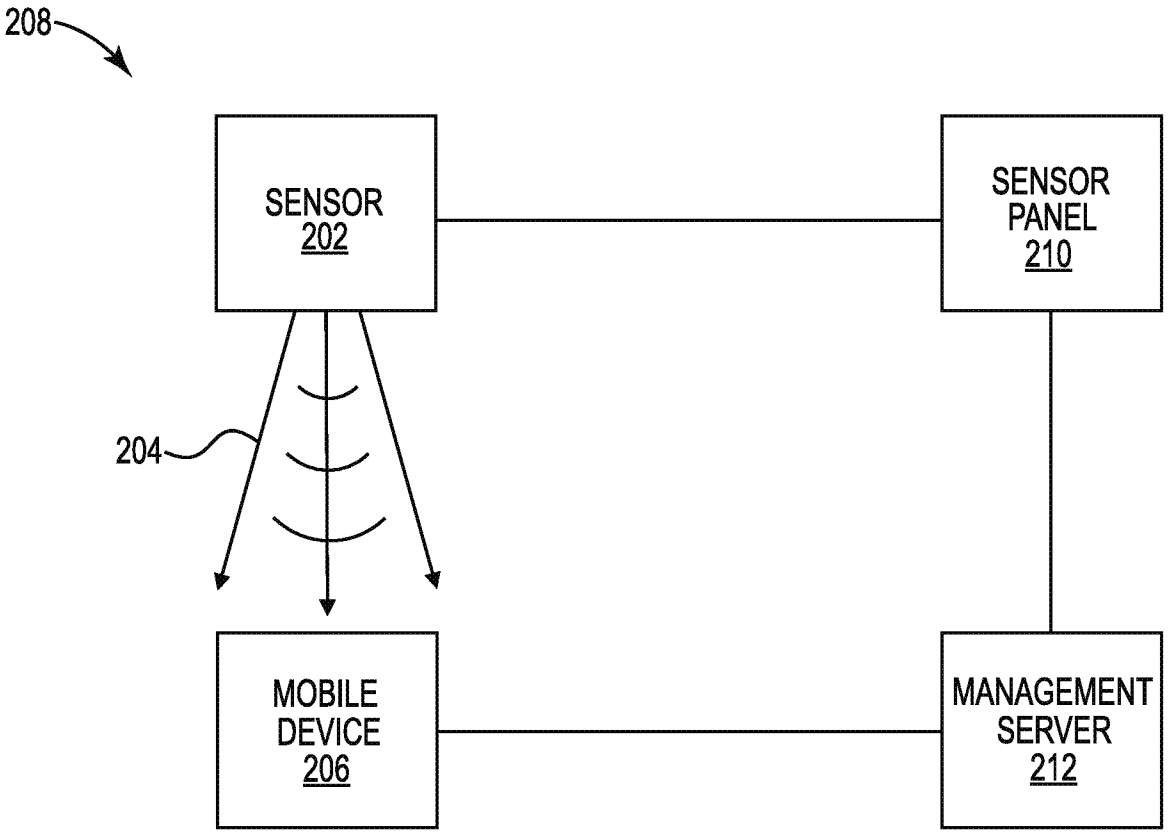
FIG. 2 is an example of a system for sensor communication testing, in accordance with one or more embodiments of the present disclosure.

FIG. 2 is an example of a system 208 for sensor communication testing, in accordance with one or more embodiments of the present disclosure. As shown in FIG. 2, the system 208 can include a sensor 202 (e.g., sensor 102, previously described in connection with FIG. 1), directed RF signal 204 (e.g., directed RF signal 104, previously described in connection with FIG. 1), mobile device 206 (e.g., mobile device 106, previously described in connection with FIG. 1), sensor panel 210, and management server 212.

Mobile device 206 can detect directed RF signal 204 from sensor 202. For example, a user may be moving through a building space with mobile device 206. Mobile device 206 may detect sensor 202 when mobile device 206 is in proximity with directed RF signal 204.

Mobile device 206 can send a self-test command to sensor 202 in response to mobile device 206 being in proximity with directed RF signal 204. For example, as shown in FIG. 2, mobile device 206 is in proximity with directed RF signal 204, and as such can send the self-test command to sensor 202.

Sensor 202 can execute a communication test in response to the self-test command from mobile device 206. The communication test includes sending, to sensor panel 210, a communication test signal. The communication test signal can include a signal to test communication between sensor 202 and sensor panel 210. As previously described in FIG. 1, a sensor panel can be a central monitoring location for sensors located in a building.

The communication test includes receiving, from sensor panel 210, a communication test response signal. The communication test response signal can include a signal to test communication between sensor panel 210 and sensor 202.

Mobile device 206 can receive a pass notification in response sensor 202 passing the communication test. Mobile device 206 can receive the pass notification from management server 212. For example, in response to mobile device 206 passing the communication test, sensor panel 210 can cause management server 212 to send a pass notification to mobile device 206. As used herein, a pass notification includes a notification sent to mobile device 206 to indicate a specific sensor has passed a communication test.

Sensor 202 can pass the communication test based on sensor 202 receiving a communication test response signal from sensor panel 210 within a threshold time of sending the communication test signal to sensor panel 210. For example, sensor 202 can send a communication test signal to sensor panel 210 and receive a communication test response signal from sensor panel 210. If the communication test response signal from sensor panel 210 is received by sensor 202 within the threshold time from sending the communication test signal, sensor 202 has passed the communication test. Mobile device 206 can receive the pass notification from management server 212 in response to sensor 202 receiving the communication test response signal from sensor panel 210 within the threshold time of sending the communication test signal.

In some embodiments, the threshold time can be ten seconds. For instance, building codes and/or regulations may call for the threshold time to be ten seconds. For example, if the communication test response signal from sensor panel 210 is received by sensor 202 within ten seconds of sensor 202 sending the communication test signal, sensor 202 has passed the communication test. Mobile device 206 can receive the pass notification from management server 212 in response to sensor 202 receiving the communication test response signal from sensor panel 210 within ten seconds of sending the communication test signal.

Mobile device 206 can receive a fail notification in response sensor 202 failing the communication test. Similar to the pass notification, mobile device 206 can receive the fail notification from management server 212. For example, in response to mobile device 206 failing the communication test, sensor panel 210 can cause management server 212 to send a fail notification to mobile device 206. As used herein, a fail notification includes a notification sent to mobile device 206 to indicate a specific sensor has failed a communication test.

Sensor 202 can fail the communication test based on sensor 202 failing to receive a communication test response signal from sensor panel 210 within a threshold time of sending the communication test signal to sensor panel 210. For example, sensor 202 can send a communication test signal to sensor panel 210 and receive a communication test response signal from sensor panel 210. If the communication test response signal from sensor panel 210 is not received by sensor 202 within the threshold time from sending the communication test signal, sensor 202 has failed the communication test. Mobile device 206 can receive the fail notification from management server 212 in response to sensor 202 not receiving the communication test response signal from sensor panel 210 within the threshold time of sending the communication test signal.

In some embodiments, if the threshold time is ten seconds, and the communication test response signal from sensor panel 210 is not received by sensor 202 within ten seconds of sensor 202 sending the communication test signal, sensor 202 has failed the communication test. Mobile device 206 can receive the fail notification from management server 212 in response to sensor 202 failing to receive the communication test response signal from sensor panel 210 within ten seconds of sending the communication test signal.

Sensor 202 can send a communication test signal to sensor panel 210 and receive a communication test response signal from sensor panel 210 via a wired or wireless network. Sensor panel 210 can cause management server 212 to send a pass notification or a fail notification via a wired or wireless network. Mobile device 206 can receive a pass notification or a fail notification from management server 212 via a wired or wireless network.

The wired or wireless network can be a network relationship that connects sensor 202, sensor panel 210, management server 212, and mobile device 206. Examples of such a network relationship can include a local area network (LAN), wide area network (WAN), personal area network (PAN), a distributed computing environment (e.g., a cloud computing environment), storage area network (SAN), Metropolitan area network (MAN), a cellular communications network, and/or the Internet, among other types of network relationships.

Management server 212 can track sensors that pass the communication test and sensors that fail the communication test. For example, as previously illustrated in FIG. 1, a building space may have multiple sensors (e.g., sensors 102-1, 102-2, 102-M). As a user utilizes mobile device 206 to perform communication tests on sensors, management server 212 may generate a list of sensors tested, including whether the sensors passed the communication test or failed the communication test.

Mobile device 206 can receive a voice command describing sensor 202. For example, a user utilizing mobile device 206 to perform sensor communication testing can provide commands, such as dictation comments, regarding sensor 202. The commands may be provided, via a wired or wireless connection, to mobile device 206 via a microphone. For example, the user may speak into a wireless headset that includes a microphone, such as a Bluetooth headset, which may transmit the commands to mobile device 206.

Commands may include commands to mark devices as passed, failed, and/or skipped, comment, and/or take corrective action. In some examples, a user may receive a pass notification that sensor 202 has passed a communication test; in response a user may dictate a command to mobile device 206 to mark sensor 202 as having passed the communication test. In some examples, a user may receive a fail notification that sensor 202 has failed a communication test; in response a user may dictate a command to mobile device 206 to mark sensor 202 as having failed the communication test. In some examples, a user may specify a collection of devices (e.g., mark all sensors in an area as passed, failed, and/or skipped).

A user may find a technical issue with a sensor during sensor communication testing. In some examples, a user may dictate a command to mobile device 206 to mark sensor 202 as skipped (e.g., the user has skipped communication testing of sensor 202). In some examples, a user may dictate a command to comment on sensor 202 and/or specify device names (e.g., "Sensor 202 is damaged", "Sensor 202 blocked by a table, table needs to be removed"). In some examples, a user may dictate a command to make a corrective action regarding sensor 202 (e.g., "Replace sensor 202").

Although commands are described as including pass, fail, skip, comment, and/or corrective action, embodiments of the present disclosure are not so limited. For example, a user may specify device names, among other types of voice commands.

Voice commands may be sent, by mobile device 206, to management server 212. The voice commands may be included in a test report, as will be further described herein.

Management server 212 can generate a test report. The test report can include sensors that pass the communication test and sensors that fail the communication test. For example, management server 212 can generate a test report indicating which sensors in a building have passed and which sensors have failed communication tests. The test report may include information such as where each sensor is located, a sensor type, sensor name, etc.

The test report may include voice command information received from a user of mobile device 206. In some examples, the test report may include which sensors the user has marked, via voice command, passed, failed, and/or skipped. In some examples, the test report may include comments made by the user, and/or corrective action dictation.

Management server 212 can send the test report to mobile device 206. The test report can provide a user of mobile device 206, via the graphical user interface of mobile device 206, information regarding sensors that have passed a communication test, sensors that have failed a communication test, sensors that were skipped (e.g., no communication test was performed), where each respective sensor is located, what each respective sensor is named, sensors that may need corrective action, and/or sensors that may need to be retested, among other information.

Utilizing voice commands during sensor communication testing can allow for hands free testing. This can enable users to perform multiple tasks simultaneously during sensor communication testing.

FIG. 3 is a schematic block diagram of a sensor 302 for sensor communication testing, in accordance with one or more embodiments of the present disclosure. As shown in FIG. 2, sensor 302 (e.g., sensor 102, 202, previously described in connection with FIGS. 1 and 2, respectively) can include a controller 313, a wireless transmitter 318, and an RF attenuator 320. Controller 313 can include a memory 316 and a processor 314 for sensor communication testing in accordance with the present disclosure.

Sensor 302 can include wireless transmitter 318 to generate an RF signal. As previously described in connection with FIG. 1, wireless transmitter 318 can be a BLE transmitter, a sub-gigahertz transmitter, a Wi-Fi transmitter, and/or a Li-Fi transmitter, among other types of transmitters.

Sensor 302 can include RF attenuator 320. RF attenuator 320 can direct the RF signal in a pre-determined direction. In an example in which sensor 302 is located in or around a ceiling area of a building space, RF attenuator 320 can direct the RF signal in a downwards direction such that a mobile device can come into proximity with the directed RF signal.

RF attenuator 320 can be a directional antenna to direct the RF signal in a pre-determined direction. As used herein, a directional antenna refers to an antenna which radiates or receives power in a specific direction.

RF attenuator 320 can be a shroud to direct the RF signal in a pre-determined direction. The shroud can absorb and/or reflect the RF signal to direct the RF signal. As used herein, a shroud refers to material used to cover or envelop a portion of sensor 302 such that the RF signal generated by RF attenuator 320 is directed in a pre-determined direction by the shroud material absorbing and/or reflecting the RF signal.

The shroud can be an RF shielding material. In some examples, the shroud can be manufactured of a material that is an RF shielding material. In some examples, the shroud can be plated by an RF shielding material. The RF shielding material can be a copper and nickel material, although embodiments of the disclosure are not limited to a copper and nickel material. As used herein, an RF shielding material refers to a material that reflects and/or absorbs RF signals.

The memory 316 can be any type of storage medium that can be accessed by the processor 314 to perform various examples of the present disclosure. For example, the memory 316 can be a non-transitory computer readable medium having computer readable instructions (e.g., computer program instructions) stored thereon that are executable by the processor 314 to receive, from a mobile device in response to the mobile device being in proximity with the pre-determined direction of the directed RF signal, a self-test command. Additionally, processor 314 can execute the executable instructions stored in memory 316 to send a communication test signal to a sensor panel in response to the self-test command, and receive a communication test response signal from the sensor panel in response to the communication test signal, where the communication test response signal indicates whether the sensor has passed or failed the communication test.

The memory 316 can be volatile or nonvolatile memory. The memory 316 can also be removable (e.g., portable) memory, or non-removable (e.g., internal) memory. For example, the memory 316 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 316 is illustrated as being located within controller 313, embodiments of the present disclosure are not so limited. For example, memory 316 can also be located internal to another computing resource (e.g., enabling computer readable instructions to be downloaded over the Internet or another wired or wireless connection).

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processor. It is presumed that logic similarly executes instructions for purposes of the embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A sensor, comprising:

a wireless transmitter configured to generate a radio-frequency (RF) signal;

an RF attenuator configured to direct the RF signal in a pre-determined direction; and a controller configured to:

receive, from a mobile device in response to the mobile device being in proximity with the pre-determined direction of the directed RF signal, a self-test command to execute a communication test;

send a communication test signal to a sensor panel in response to the self-test command; and receive a communication test response signal from the sensor panel in response to the communication test signal, wherein the communication test response signal indicates whether the sensor has passed or failed the communication test.

2. The sensor of claim 1, wherein the wireless transmitter is a low energy transmitter.

3. The sensor of claim 1, wherein the RF attenuator is a directional antenna configured to direct the RF signal in the pre-determined direction.

4. The sensor of claim 1, wherein the RF attenuator is a shroud configured to at least one of absorb and reflect the RF signal such that the RF signal is directed in the pre-determined direction.

5. The sensor of claim 1, wherein the wireless transmitter is a Bluetooth low energy transmitter.

6. The sensor of claim 1, wherein the wireless transmitter is a sub-gigahertz transmitter.

7. The sensor of claim 1, wherein the wireless transmitter is a Wireless Fidelity (Wi-Fi) transmitter.

8. The sensor of claim 1, wherein the wireless transmitter is a Light Fidelity (Li-Fi) transmitter.

9. A system for sensor communication testing, comprising:

a sensor, including a wireless transmitter configured to generate a radio-frequency (RF) signal and an RF attenuator configured to direct the RF signal in a pre-determined direction; and a mobile device configured to send, to a controller of the sensor, a self-test command in response to the mobile device being in proximity with the directed RF signal to cause the sensor to execute a communication test;

wherein:

the sensor sends, to a sensor panel in response to the self-test command, a communication test signal;

the mobile device receives a pass notification from a management server connected to the sensor panel in response to the sensor passing the communication test; and the mobile device receives a fail notification from the management server in response to the sensor failing the communication test.

10. The system of claim 9, wherein the mobile device receives the pass notification from the management server in response to the sensor receiving a communication test response signal from the sensor panel within a threshold time of sending the communication test signal.

11. The system of claim 9, wherein the mobile device receives the fail notification from the management server in response to the sensor failing to receive a communication test response signal from the sensor panel within a threshold time of sending the communication test signal.

12. The system of claim 9, wherein the sensor is a heating, ventilation, and air-conditioning (HVAC) sensor.

13. The system of claim 9, wherein the sensor is a lighting sensor.

14. The system of claim 9, wherein the sensor is at least one of a smoke and fire sensor.

15. The system of claim 9, wherein the management server tracks sensors that pass the communication test and sensors that fail the communication test.

16. A method for sensor communication testing, comprising:

detecting, by a mobile device, directed radio-frequency (RF) signals from a number of sensors;

sending, by the mobile device, a self-test command to a sensor among the number of sensors in response to the mobile device being in proximity with a directed RF signal of the sensor;

executing, by the sensor, a communication test in response to the self-test command, wherein the communication test includes:

sending, to a sensor panel, a communication test signal; and receiving, from the sensor panel, a communication test response signal;

receiving, by the mobile device from a management server connected to a sensor panel, a pass notification in response to the sensor passing the communication test; and receiving, by the mobile device from the management server, a fail notification in response to the sensor failing the communication test.

17. The method of claim 16, wherein the method includes receiving, by the mobile device, a test report that includes sensors that pass the communication test and sensors that fail the communication test.

18. The method of claim 16, wherein the method includes:

receiving, by the mobile device, the pass notification from the management server in response to the sensor receiving the communication test response signal from the sensor panel within ten seconds of sending the communication test signal; and receiving, by the mobile device, the fail notification from the management server in response to the sensor failing to receive the communication test response signal from the sensor panel within ten seconds of sending the communication test signal.

19. The method of claim 16, wherein the method includes receiving, by the mobile device, a voice command describing the sensor.

20. The method of claim 19, wherein method includes sending, by the mobile device, the voice command to the management server to be included in a test report generated by the management server.

* * * * *